US006665512B1

(12) United States Patent
Yanagida et al.

(10) Patent No.: US 6,665,512 B1
(45) Date of Patent: Dec. 16, 2003

(54) IMAGE FORMING APPARATUS

(75) Inventors: Masato Yanagida, Tokyo (JP); Tadashi Hayakawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/520,728

(22) Filed: Mar. 8, 2000

(30) Foreign Application Priority Data

Mar. 10, 1999 (JP) ..... 11-062562
Jan. 24, 2000 (JP) ..... 2000-014792

(51) Int. Cl.[7] ..... G03G 15/16
(52) U.S. Cl. ..... 399/313; 399/308; 492/27
(58) Field of Search ..... 399/313, 302, 399/308, 297; 492/18, 49, 53, 56, 27

(56) References Cited

U.S. PATENT DOCUMENTS 3,984,183 A * 10/1976 Maksymiak ..... 399/313
5,600,428 A 2/1997 Yanagida ..... 399/399
5,881,347 A * 3/1999 May et al. ..... 399/302
6,072,977 A * 6/2000 Murakami ..... 399/313
6,078,774 A * 6/2000 Kim et al. ..... 399/302 X

FOREIGN PATENT DOCUMENTS

JP 04-321082 * 11/1992
JP 6-186812 7/1994
JP 7-225523 8/1995
JP 8-234545 9/1996

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes a transfer roller pressed against an image carrier for transferring an image from the image carrier to a recording medium being conveyed via a nip between the transfer roller and the image carrier. The transfer roller is positioned in an angular range of less than ±90° from the top of said image carrier in the direction of rotation of the image carrier. In addition, the transfer roller has a greater diameter at its opposite end portions than at its center portion in the axial direction thereof.

5 Claims, 7 Drawing Sheets

IMAGE FORMING APPARATUS

BACKGROUND OF THE INVENTION

The present invention relates to a copier, printer, facsimile apparatus or similar image forming apparatus and more particularly to an image transfer device included therein and a charge roller, developing roller, transfer roller, cleaning roller or similar roller joining in image formation.

Generally, an image forming apparatus of the kind described includes a photoconductive drum or similar image carrier. An image transfer device includes a transfer roller pressed against the lower portion of the image carrier with opposite end portions thereof pressed by a pressing device. A charger uniformly charges the surface of the image carrier with a charge roller. A developing unit includes a developing roller for developing a latent image electrostatically formed on the image carrier. A cleaning unit includes a cleaning roller for removing toner left on the image carrier after image transfer. A bias power source applies a bias for image transfer to the transfer roller, so that the transfer roller transfers an image from the image carrier to a paper or similar recording medium.

Japanese Patent Laid-Open Publication No. 52-80842, for example, teaches an electrophotographic copier including a photoconductive drum and an image transfer device including a transfer charger. The transfer charger adjoins the photoconductive drum. A paper guide implemented as a guide roller is positioned upstream of the transfer charger in a direction of paper transport in the vicinity of the photoconductive drum. The guide roller has a greater outside diameter at its center than at its opposite ends, so that the center portion of a paper reached the roller first contacts the drum.

Japanese Patent Laid-Open Publication No. 4-321082 discloses an image forming apparatus including a photoconductive drum and an image transfer device implemented as an elastic transfer roller pressed against the drum. The transfer roller transfers an image from the photoconductive drum to a paper being conveyed between the transfer roller and the drum. The transfer roller has a circumferential surface configured in an inverse crown.

Japanese Patent Laid-Open Publication No. 4-127176 proposes an image forming apparatus including a rotatable charge roller for depositing a preselected potential on a photoconductive element. A developing roller develops a latent image formed on the photoconductive element by exposure with a developer. A transfer roller transfers the resulting toner image from the photoconductive drum to a paper. A cleaning roller removes toner left on the photoconductive element after the image transfer. At least one of the above rollers is uniformly pressed against the photoconductive element in its axial direction by leaf springs.

Japanese Patent Laid-Open Publication No. 2-24685 discloses an image forming apparatus including a movable image carrier and a conductive, elastic transfer roller adjoining the image carrier and movable in synchronism with the image carrier. A paper is fed to a nip between the image carrier and the transfer roller. The transfer roller has a greater outside diameter at its center portion than at its opposite end portions.

Further, Japanese Patent Laid-Open Publication No. 8-234545 proposes an image forming apparatus including a transfer roller positioned above a photoconductive drum.

Transfer rollers in general have a metallic core and a sag problem, as follows. While a transfer roller with a metallic core having a great diameter does not sag, it is bulky and heavy. If the diameter of the metallic core is small, then the transfer roller sags due to its own weight. As the transfer roller is made longer, it sags more and cannot maintain a uniform nip width between it and an image carrier.

More specifically, so long as the transfer roller is shorter than 350 mm, the transfer roller does not sag by more than 0.1 mm even when its core (formed of iron) has a relatively small diameter (8 mm). However, the sag sharply increases when the above length exceeds 350 mm. Because the transfer roller is usually pressed against the lower portion of an image carrier, the nip width is smaller at the center portion than at the opposite end portions due to the sag of the roller. This is likely to bring about defective images that are locally lost. On other hand, assume that the transfer roller is positioned above an image carrier and pressed against the image carrier with its opposite ends pressed by a pressing device. Then, the nip width is greater at the center portion than at the opposite end portions due to the sag of the transfer roller, resulting in irregular image transfer and therefore defective images.

The above sag problem also occurs with a charge roller, a developing roller, a cleaning roller and other rollers arranged in an image forming apparatus. For example, the charge roller, developing roller and cleaning roller respectively render charging, development and cleaning irregular due to their sag, also resulting in defective images.

Technologies relating to the present invention are also disclosed in, e.g., Japanese Patent Laid-Open Publication Nos. 6-186812 and 7-225523.

SUMMARY OF THE INVENTION

It is therefore an object of the present invention to provide an image forming apparatus capable of obviating defective images ascribable to the sag of rollers included therein.

An image forming apparatus of the present invention includes an image carrier and an elastic transfer roller pressed against the image carrier and conveys a recording medium between the transfer roller and the image carrier to thereby transfer a toner image from the image carrier to the recording medium. The transfer roller is positioned in an angular range of less than ±90° from the top of the image carrier in the direction of rotation of the image carrier. The transfer roller has a greater diameter at its opposite end portions than at its center portion in the axial direction of the roller. Alternatively, the transfer roller may have lower hardness, lower density or lower electric resistance at the opposite end portions than at the center portion. This roller configuration is similarly applicable to any other roller included in the image forming apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
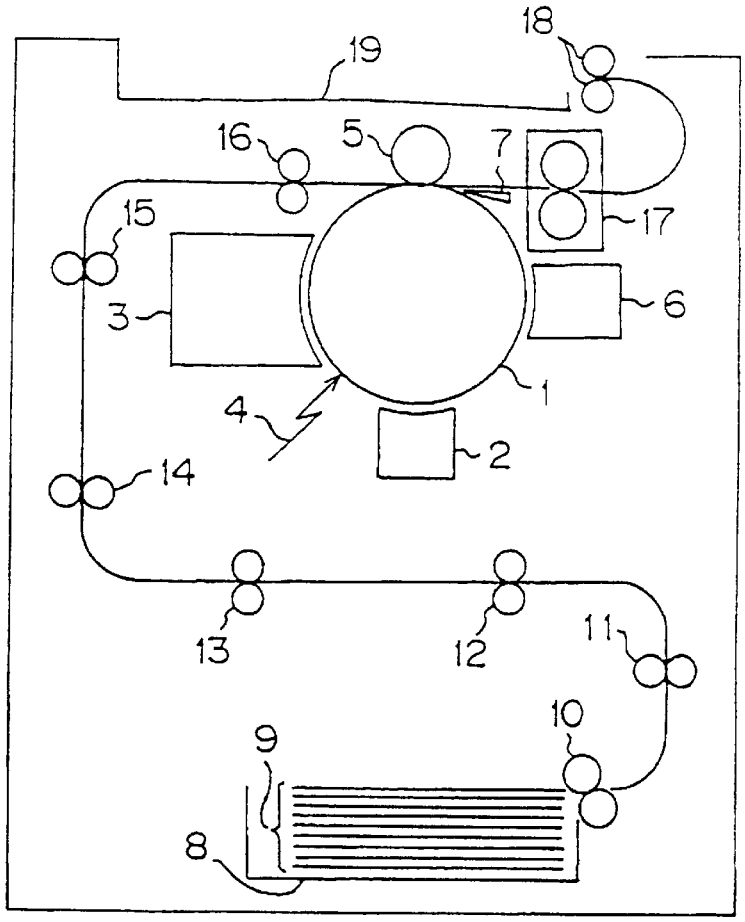
FIG. 1 is a section showing a first embodiment of the image forming apparatus in accordance with the present invention.

Referring to FIG. 1 of the drawings, an image forming apparatus embodying the present invention is shown and includes a photoconductive element or image carrier 1 implemented as a drum by way of example (drum 1 hereinafter). The drum 1 is positioned substantially horizontally and caused to rotate by a drive section not shown. A charger or charging means 2 is located beneath the drum 1 for uniformly charging the surface of the drum 1. A developing unit or developing means 3 is positioned at the left-hand side of the drum 1, as viewed in FIG. 1, for developing a latent image electrostatically formed on the drum 1.

An optical writing unit or exposing means, which is represented by a beam 4, optically scans the charged surface of the drum 1 between a charging position where the charger 2 is located and a developing position where the developing unit 3 is located, thereby forming a latent image. A transfer roller 5 is positioned above the drum 1 and constitutes an image transfer device. The transfer roller 5 is pressed against the drum 1 with opposite ends of its metallic core pressed by a pressing device. In this condition, a nip for image transfer is formed between the transfer roller 5 and the drum 1.

Figure 13A:
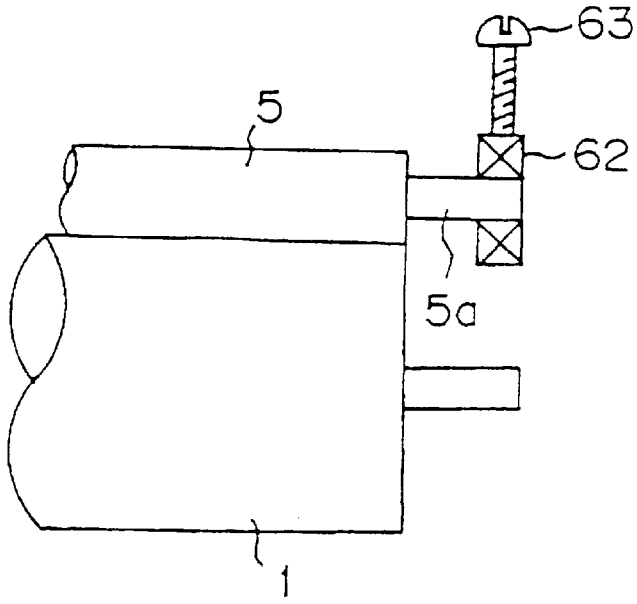
FIGS. 13A and 13B are fragmentary views each showing a particular specific configuration of a pressing device applicable to the illustrative embodiments.
Figure 13B:
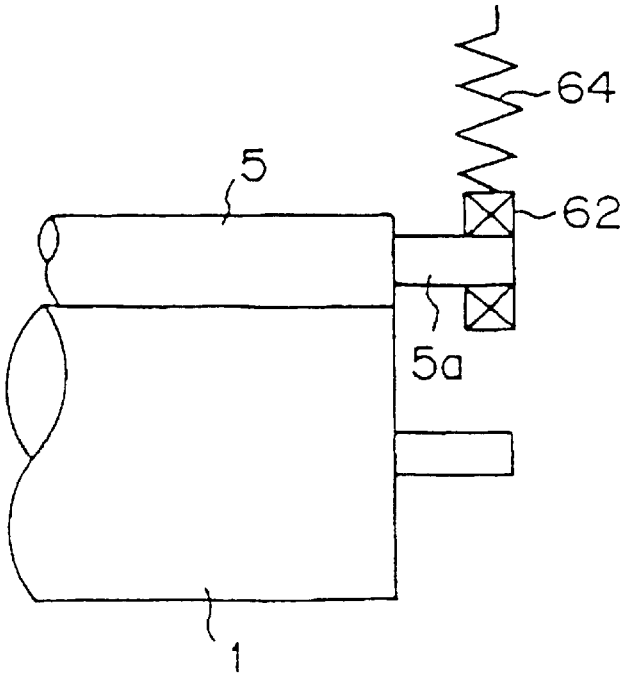

FIGS. 13A and 13B each show a particular specific configuration of the above pressing device. In FIG. 13A, each end of a metallic core 5*a* included in the transfer roller 5 is rotatably supported by a bearing 62 which is, in turn, pressed by a screw 63. In FIG. 13B, the bearing 62 supporting the core 5*a* is pressed by a spring 64. If desired, both the screw 63 and spring 64 may be used to press the bearing 62.

Figure 2:
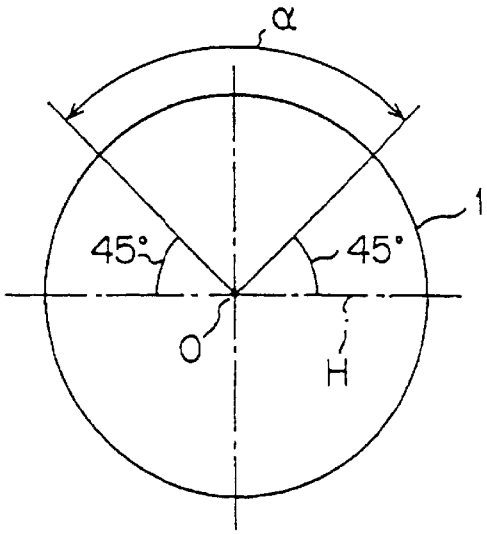
FIG. 2 is a section of a photoconductive drum included in the illustrative embodiment, showing an angular range where an image transfer nip is positioned.

The transfer roller 5 is positioned above a horizontal plane containing the axis of the drum 1. More specifically, as shown in FIG. 2, assume a horizontal plane H containing the axis 0 of the drum 1, and an angular range a of 45° to 135° as measured from the plane H in the counterclockwise direction. Then, the transfer roller 5 should preferably be pressed against the drum 1 within the above range $\alpha$, i.e., a range extending over 45° from the top of the drum 1 right above the axis 0 in each of the clockwise and counterclockwise directions with respect to the rotation of the drum 1. The nip is therefore formed within the range $\alpha$.

Figure 3:
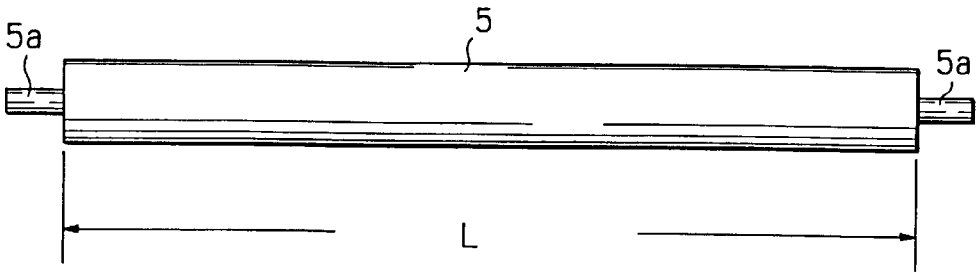
FIG. 3 is an elevation showing the effective width of a transfer roller also included in the illustrative embodiment.

As shown in FIG. 3, the transfer roller 5 has an effective width or overall length L capable of effecting image transfer. The effective width L is 350 mm or above, e.g., 1 m. At least part of the transfer roller 5 expected to contact the drum 1 is formed of urethane rubber or similar elastic material. For example, an elastic layer implemented by urethane rubber is formed on a metallic core having a diameter of, e.g., 8 mm. A bias power source, not shown, applies a bias for image transfer to the core.

Figure 4:
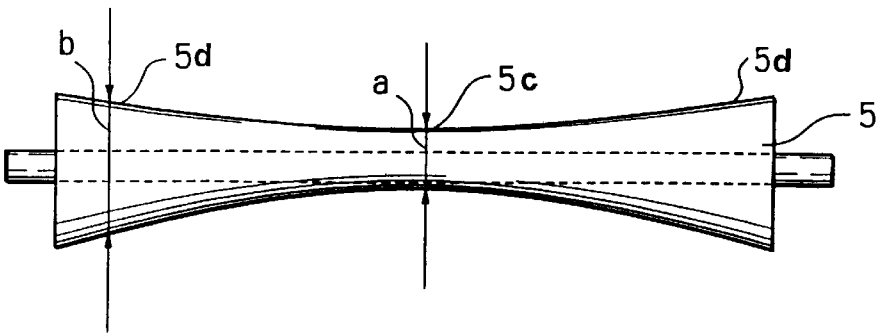
FIG. 4 is a view similar to FIG. 3, showing the configuration of the transfer roller unique to the illustrative embodiment.

As shown in FIG. 4 the transfer roller 5 has a diameter a (e.g. 15.8 mm) at its center portion 5*c* in the axial direction and has a diameter b (e.g. 16 mm) at its opposite end portions 5*d*. That is, the diameter b is greater than the diameter $\alpha$. The diameter of the transfer roller 5 therefore sequentially increases from the center portion 5*c* toward the end portions 5*d*.

So long as the effective width L of the transfer roller 5 is 350 mm or above, the sag of the roller 5 can be reduced if the core diameter is increased. The core diameter, however, cannot be increased above a certain limit. In the illustrative embodiment, the diameter of the roller 5 sequentially increasing from the center portion to toward the end portions is successful to absorb the sage of the roller 5.

Referring again to FIG. 1, a drum cleaning unit 6 is positioned at the right-hand side of the drum 1 for cleaning the drum 1. A peeler 7 is located between the transfer roller 5 and the cleaning unit 6.

In operation, the charger 2 uniformly charges the surface of the drum 1 being rotated by the drive section. The writing unit scans the charged surface of the drum 1 with the beam 4 to thereby electrostatically form a latent image. The developing unit 3 develops the latent image so as to produce a corresponding toner image. A pickup roller 10 pays out a paper or similar recording medium 9 from a tray 8. Roller pairs 11 through 16 convey the paper 9 to the nip between the drum 1 and the transfer roller 5.

The transfer roller 5 applied with the previously stated bias electrostatically transfers the toner image from the drum 1 to the paper 9 being conveyed via the nip. The paper 9 with the toner image is removed from the drum 1 by the peeler 7 and conveyed to a fixing unit 17. The fixing unit 17 fixes the toner image on the paper 9. An outlet roller pair 18 drives the paper or print 9 coming out of the fixing unit 17 to a tray 19.

As stated above, in the illustrative embodiment, the transfer roller 5 is positioned within the angular range of ±90° from the top of the drum 1 in the direction of rotation of the drum 1. In addition, the diameter of the transfer roller 5 is greater at opposite end portions than at the center portion in the axial direction of the roller 5. With this configuration, the transfer roller 5 sags little despite its own weight. This successfully reduces the variation of the width of the roller portion contacting the drum 1 and thereby reduces the local omission of a toner image ascribable to the sag of the roller 5. Further, the ratio in diameter between the center portion and the opposite end portions is optimized in order to further reduce the sag of the roller 5. The roller 5 therefore contacts the drum 1 in a straight position and obviates the local omission of a toner image.

Figure 5:
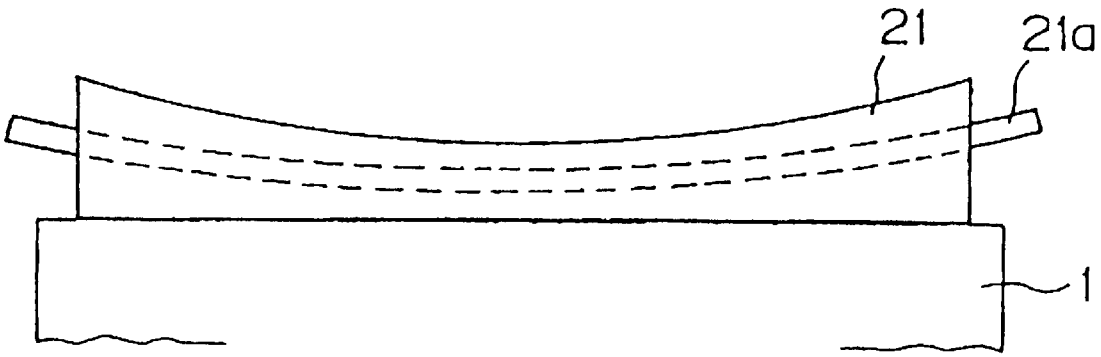
FIGS. 5 and 6 are side elevations showing transfer rollers respectively representative of a second and a third embodiment of the present invention.
Figure 6:
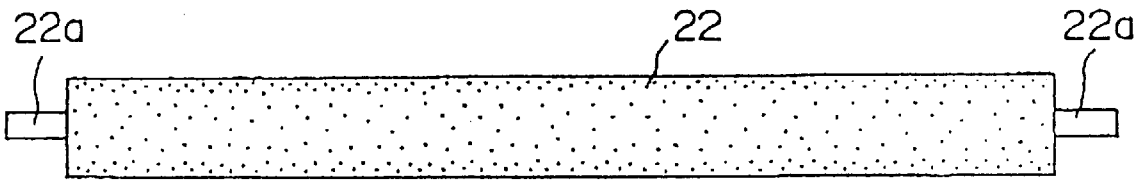

FIG. 5 shows a transfer roller 21 representative of a second embodiment of the present invention. As shown, the transfer roller 21, which is a substitute for the transfer roller 5, includes a metallic core 21*a*. At least part of the transfer roller 21 expected to contact the drum 1 is formed of an elastic material, as in the previous embodiment. In this embodiment, the above part of the roller 21 has lower hardness at opposite end portions than at a center portion in the axial direction of the roller 21, i.e., the hardness sequentially decreases from the center portion toward opposite end portions. For example, the hardness is 30° at the center portion and lower than 30° at the opposite end portions (Ascar C scale).

As stated above, in the illustrative embodiment, the hardness of the transfer roller 21 is lower at opposite end portions than at the center portion in the axial direction of the roller 21. This, coupled with the fact that the roller 21 is positioned within the angular range of ±90° from the top of the drum 1 in the direction of rotation of the drum 1, reduces the sag of the roller 21 ascribable to its own weight. Therefore, the variation of the width of the roller portion contacting the drum 1 and therefore the local omission of a toner image ascribable to the sag of the roller 21 is reduced. Further, the ratio in hardness between the center portion and the opposite end portions is optimized in order to further reduce the sag of the roller 21. The roller 21 therefore contacts the drum 1 in a straight position and obviates the local omission of a toner image.

FIG. 3 shows a transfer roller 22 representative of a third embodiment of the present invention. As shown, the transfer roller 22, which is another substitute for the transfer roller 5, includes a metallic core 22*a*. Again, at least part of the roller 22 expected to contact the drum 1 is formed of an elastic material. In the illustrative embodiment, the roller 22 has lower density at opposite end portions than at the center portion, i.e., the density sequentially decreases from the center portion toward the opposite end portions. For example, the density is 1 g/cm$^2$ at the center portion and lower than 1 g/cm$^2$ at the opposite end portions.

As stated above, in the illustrative embodiment, the density of the transfer roller 22 is lower at opposite end portions than at the center portion in the axial direction of the roller 22. This, coupled with the fact that the roller 22 is positioned within the angular range of ±90° from the top of the drum 1 in the direction of rotation of the drum 1, reduces the sag of the roller 22 ascribable to its own weight. Therefore, the variation of the width of the roller portion contacting the drum 1 and therefore the local omission of a toner image ascribable to the sag of the roller 22 is reduced. Further, the ratio in density between the center portion and the opposite end portions is optimized in order to further reduce the sag of the roller 22. The roller 22 therefore contacts the drum 1 in a straight position and obviates the local omission of a toner image.

In a fourth embodiment of the present invention, a transfer roller replacing the transfer roller 5 also has part thereof expected to contact the drum 1 formed of an elastic material. In this embodiment, the transfer roller has lower electric resistance at opposite end portions than at the center portion, i.e., the electric resistance sequentially decreases from the center portion toward the opposite end portions. Such an electric resistance distribution may be implemented by, e.g., control ling the mixture ratio of metal powder constituting the elastic material. The above electric resistance distribution maintains the potential of the surface of the roller contacting the drum 1 uniform even when the roller sags due to its own weight, thereby obviating defective images. The roller allows charge to uniformly act on the drum 1 because the electric resistance is high at the center of the nip.

As stated above, in the illustrative embodiment, the elastic material of the transfer roller has electric resistance lower at opposite end portions than at the center portion in the axial direction of the roller. In addition, the transfer roller is positioned within the angular range of ±90° from the top of the drum 1 in the direction of rotation of the drum 1. Therefore, even when the roller sags due to its own weight and contacts the drum 1 from above the drum 1, the potential of the roller remains substantially uniform because the electric resistance of the elastic material is higher at the center portion than at the opposite ends; the roller sags most at the center portion. Consequently, the local omission of a toner image ascribable to the sag of the roller is obviated.

Figure 7:
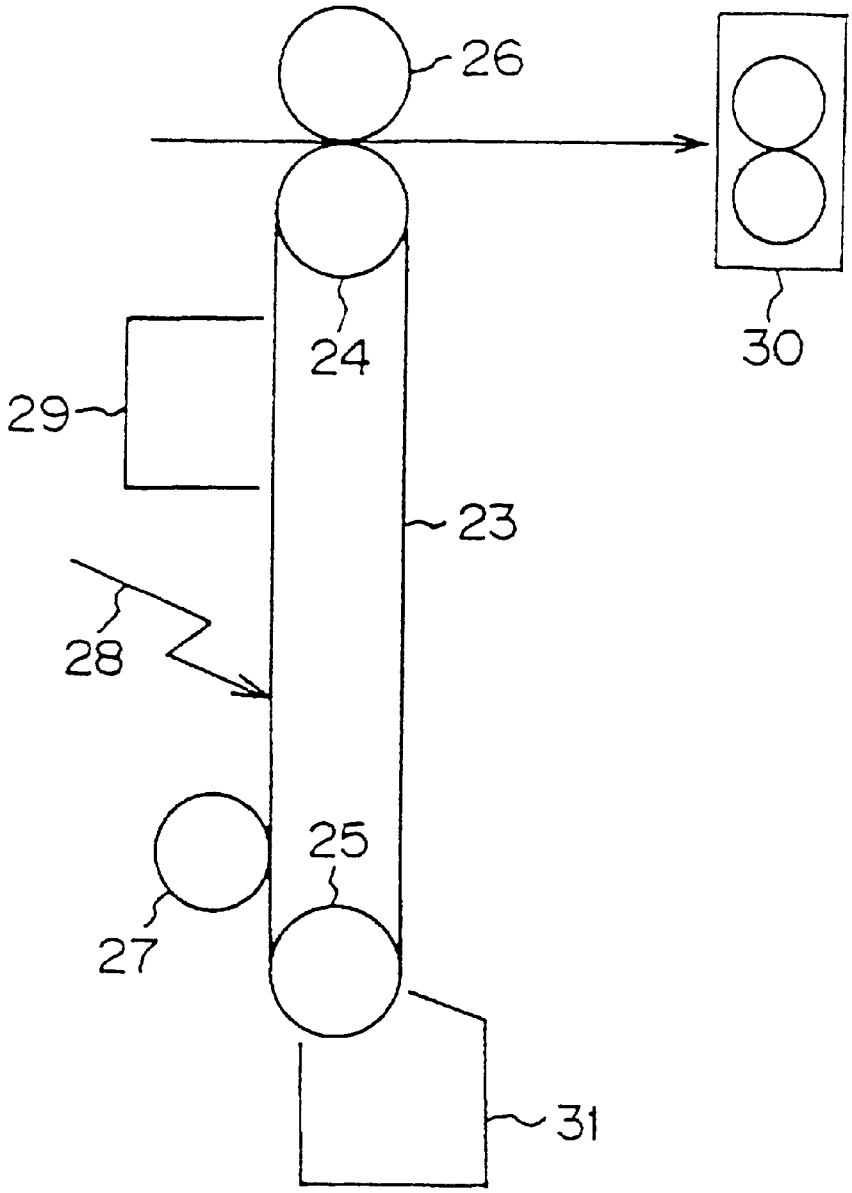
FIGS. 7 through 12 are sections respectively showing a fifth, a ninth, a thirteenth, a seventeenth, a twenty-first and a twenty-fifth embodiment of the present invention.

Referring to FIG. 7, a fifth embodiment of the present invention will be described. As shown, the photoconductive element is implemented as a belt 23 passed over rollers 24 and 25. A motor, not shown, is drivably connected to one of the rollers 24 and 25 so as to cause the belt 23 to turn. A transfer roller 26 representative of an image transfer device is positioned above the portion of the belt 23 passed over the roller 24.

The transfer roller 26 is positioned above a horizontal plane containing the center of the portion of the belt 23 passed over the roller 24, i.e., the axis of the roller 24. More specifically, assume a horizontal plane containing the center of the above portion of the belt 23, and an angular range of 45° to 135° as measured from the horizontal plane in the counterclockwise direction. Then, the transfer roller 26 should preferably be pressed against the belt 23 within the above range, i.e. , a range extending over 45° from the top of the belt 23 right above the center of the above portion of the belt 23 in each of the clockwise and counterclockwise directions with respect to the rotation of the belt 23. Therefore, a nip is formed between the belt 23 and the transfer roller 26 within the above angular range. The roller 26 is pressed against the belt 23 with opposite ends of its metallic core pressed by a pressing device.

The transfer roller 26 has a greater diameter at the opposite end portions than at the center portion in the axial direction. For example, the diameter of the transfer roller 26 sequentially increases from the center portion toward the end portions. This configuration is successful to absorb the sag of the roller 26.

In operation, a charger or charging means 27 uniformly charges the surface of the belt 23. A writing unit, not shown, scans the charged surface of the belt 23 with a beam 28 to thereby electrostatically form a latent image. A developing unit 29 develops the latent image so as to produce a corresponding toner image. A paper fed from a paper feeder, not shown, is conveyed via the nip between the belt 23 and the transfer roller 26.

The transfer roller 26 applied with a bias from a bias power source, not shown, electrostatically transfers the toner image from the belt 23 to the paper being conveyed via the nip. The paper with the toner image is removed from the belt 23 and conveyed to a fixing unit 30. The fixing unit 30 fixes the toner image on the paper. Finally, the paper or print is driven out of the apparatus to a tray not shown. A belt cleaning unit 31 cleans the surface of the belt 23 after the image transfer.

As stated above, in the illustrative embodiment, the transfer roller 26 is positioned within the angular range of ±90° from the top of the belt 23 in the direction of rotation of the belt 23. In addition, the diameter of the transfer roller 26 is greater at opposite end portions than at the center portion in the axial direction of the roller 26. With this configuration, the transfer roller 26 sags little despite its own weight. This successfully reduces the variation of the width of the roller portion contacting the belt 23 and thereby reduces the local omission of a toner image ascribable to the sag of the roller 26. Further, the ratio in diameter between the center portion and the opposite end portions is optimized in order to further reduce the sag of the roller 26. The roller 26 therefore contacts the belt 23 in a straight position and obviates the local omission of a toner image.

A sixth to an eighth embodiment of the present invention each use any one of the transfer rollers of the second to fourth embodiments in place of the above transfer roller 26, although not shown or described specifically. The sixth to eight embodiments achieve the same advantages as the second to fourth embodiments.

Figure 8:
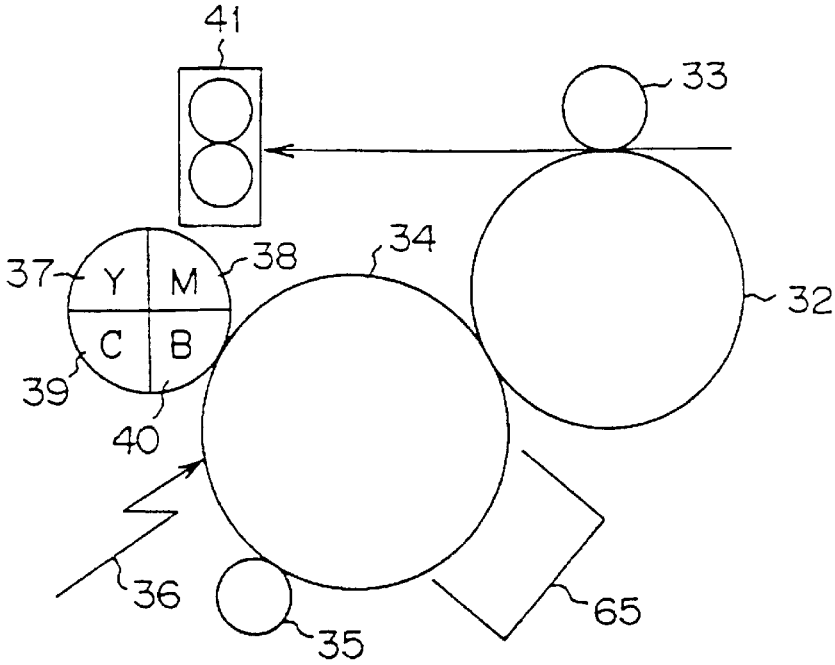

Reference will be made to FIG. 8 for describing a ninth embodiment of the present invention. As shown, the illustrative embodiment includes an intermediate transfer drum 32 and a transfer roller 33 positioned above the drum 32.

The transfer roller 33 is positioned above a horizontal plane containing the axis of the intermediate transfer drum 32. More specifically, assume a horizontal plane containing the axis of the intermediate transfer drum 32, and an angular range of 45° to 135° as measured from the horizontal plane in the counterclockwise direction. Then, the transfer roller 33 should preferably be pressed against the intermediate transfer drum 32 within the above angular range, i.e., a range extending over 45° from the top of the drum 32 right above the axis of the drum 32 in each of the clockwise and counterclockwise directions with respect to the rotation of the drum 32. A nip is therefore formed between the transfer roller 33 and the intermediate transfer drum 32 within the above angular range. The transfer roller 33 is pressed against the intermediate transfer drum 32 with opposite ends of its metallic core pressed by a pressing device not shown.

The transfer roller 33 has a greater diameter at opposite end portions than at the center portion. For example, the diameter of the transfer roller 33 sequentially increases from the center portion toward the end portions. This configuration absorbs the sag of the roller 33. The intermediate transfer drum 32 is held in contact with a photoconductive drum 34 and driven by a motor not shown.

A motor, not shown, causes the drum 34 to rotate at the same peripheral speed as the intermediate transfer drum 32. A charger or charging means 35 uniformly charges the surface of the drum 34. An optical writing unit scans the charged surface of the drum 34 with a beam 36 modulated by yellow image data, thereby forming a latent image on the drum 34. A rotary developing unit, or revolver as referred to hereinafter, develops the above latent image with a yellow developing section 37 to thereby form a corresponding yellow toner image. The yellow toner image is transferred from the drum 34 to the intermediate transfer drum 32. A drum cleaning unit 65 cleans the surface of the drum 34 after the image transfer.

Subsequently, after the charger 35 has uniformly charged the surface of the drum 34, the writing unit scans the charged surface of the drum 34 with a beam 36 modulated by magenta image data, thereby forming a latent image on the drum 34. The revolver develops the latent image with a magenta developing section 38 to thereby form a corresponding magenta toner image. The magenta toner image is transferred from the drum 34 to the intermediate transfer drum 32 over the yellow toner image existing on the drum 32. Again, the drum cleaning unit 65 cleans the surface of the drum 34 after the image transfer.

Likewise, after the charger 35 has uniformly charged the surface of the drum 34, the writing unit scans the charged surface of the drum 34 with a beam 36 modulated by cyan image data, thereby forming a latent image on the drum 34. The revolver develops the latent image with a cyan developing section 39 to thereby form a corresponding cyan toner image. The cyan toner image is transferred from the drum 34 to the intermediate transfer drum 32 over the composite yellow and magenta toner image existing on the drum 32. Again, the drum cleaning unit 65 cleans the surface of the drum 34 after the image transfer.

Finally, after the charger 35 has uniformly charged the surface of the drum 34, the writing unit scans the charged surface of the drum 34 with a beam 36 modulated by black image data, thereby forming a latent image on the drum 34. The revolver develops the latent image with a black developing section 40 to thereby form a corresponding black toner image. The black toner image is transferred from the drum 34 to the intermediate transfer drum 32 over the composite yellow, magenta and cyan toner image existing on the drum 32, completing a full-color image. Again, the drum cleaning unit 65 cleans the surface of the drum 34 after the image transfer.

While a paper fed form a paper feeder, not shown, is conveyed via the nip between the intermediate transfer drum 32 and the transfer roller 33, the full-color image is transferred from the drum 32 to the paper. A fixing unit 41 fixes the toner image on the paper. The resulting print is driven out of the apparatus to a tray not shown.

As stated above, in the illustrative embodiment, the transfer roller 33 is positioned within the angular range of ±90° from the top of the intermediate transfer drum or image carrier 32 in the direction of rotation of the drum 32. In addition, the diameter of the transfer roller 33 is greater at opposite end portions than at the center portion in the axial direction of the roller 33. With this configuration, the transfer roller 33 sags little despite its own weight. This successfully reduces the variation of the width of the roller portion contacting the intermediate transfer drum 32 and thereby reduces the local omission of a toner image ascribable to the sag of the 33. Further, the ratio in diameter between the center and the opposite ends is optimized in order to further reduce the sag of the roller 33. The roller 33 therefore contacts the image carrier 32 in a straight position and obviates the local omission of a toner image.

A tenth to a twelfth embodiment of the present invention each use any one of the transfer rollers of the second to fourth embodiments in place of the above transfer roller 33, although not shown or described specifically. The tenth to twelfth embodiments achieve the same advantages as the second to fourth embodiments.

Figure 9:
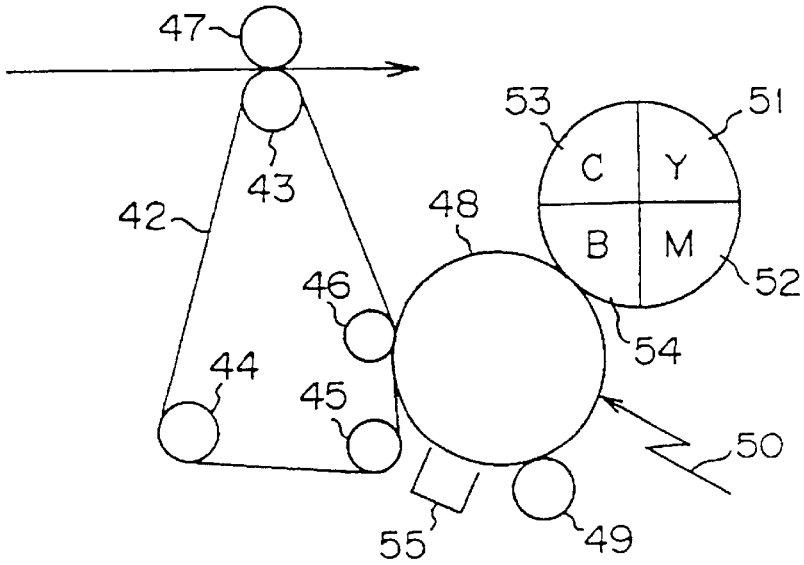

A thirteenth embodiment of the present invention will be described with reference to FIG. 9. As shown, the illustrative embodiment includes an intermediate transfer belt or image carrier 42 passed over rollers 43 through 46. A motor, not shown, drives one of the rollers 43 through 46 for thereby causing the intermediate transfer belt 42 to turn. A transfer roller 47 representative of an image transfer device is positioned above the portion of the belt 42 passed over the roller 43. A bias power source, not shown, applies a bias for image transfer to the transfer roller 47.

The transfer roller 47 is positioned above a horizontal plane containing the center of the portion of the belt 42 passed over the roller 43, i.e., the axis of the roller 43. More specifically, assume a horizontal plane containing the center of the above portion of the belt 42, and an angular range of 45° to 135° as measured from the horizontal plane in the counterclockwise direction. Then, the transfer roller 47 should preferably be pressed against the belt 42 within the above angular range, i.e., a range extending over 45° from the top of the belt 42 right above the center of the above portion of the belt 42 in each of the clockwise and counterclockwise directions with respect to the rotation of the belt 42. Therefore, a nip is formed between the belt 42 and the transfer roller 47 within the above angular range. The roller 47 is pressed against the belt 42 with opposite ends of its metallic core pressed by a pressing device.

A motor, not shown, causes a photoconductive drum 48 to rotate at the same peripheral speed as the intermediate transfer belt 42. A charger or charging means 49 uniformly charges the surface of the drum 48. An optical writing unit scans the charged surface of the drum 48 with a beam 50 modulated by yellow image data, thereby forming a latent image on the drum 48. A revolver develops the above latent image with a yellow developing section 51 to thereby form a corresponding yellow toner image. The yellow toner image is transferred from the drum 48 to the intermediate transfer belt 42. A drum cleaning unit 55 cleans the surface of the drum 48 after the image transfer.

Subsequently, after the charger 49 has uniformly charged the surface of the drum 48, the writing unit scans the charged surface of the drum 48 with a beam 50 modulated by magenta image data, thereby forming a latent image on the drum 48. The revolver develops the latent image with a magenta developing section 52 to thereby form a corresponding magenta toner image. The magenta toner image is transferred from the drum 48 to the intermediate transfer belt 42 over the yellow toner image existing on the belt 42. Again, the drum cleaning unit 55 cleans the surface of the drum 48 after the image transfer.

Likewise, after the charger 49 has uniformly charged the surface of the drum 48, the writing unit scans the charged surface of the drum 48 with a beam 50 modulated by cyan image data, thereby forming a latent image on the drum 34. The revolver develops the latent image with a cyan developing section 53 to thereby form a corresponding cyan toner image. The cyan toner image is transferred from the drum 48 to the intermediate transfer belt 42 over the composite yellow and magenta toner image existing on the belt 42. Again, the drum cleaning unit 55 cleans the surface of the drum 48 after the image transfer.

Finally, after the charger 49 has uniformly charged the surface of the drum 48, the writing unit scans the charged surface of the drum 48 with a beam 50 modulated by black image data, thereby forming a latent image on the drum 34. The revolver develops the latent image with a black developing section 54 to thereby form a corresponding black toner image. The black toner image is transferred from the drum 48 to the intermediate transfer belt 42 over the composite yellow, magenta and cyan toner image existing on the belt 42, completing a full-color image. Again, the drum cleaning unit 55 cleans the surface of the drum 48 after the image transfer.

While a paper fed form a paper feeder, not shown, is conveyed through the nip between the intermediate transfer belt 42 and the transfer roller 47, the full-color image is transferred from the belt 42 to the paper. A fixing unit, not shown, fixes the toner image on the paper. The resulting print is driven out of the apparatus to a tray not shown.

As stated above, in the illustrative embodiment, the transfer roller 47 is positioned within the angular range of ±90° from the top of the intermediate transfer belt or image carrier 42 in the direction of rotation of the belt 42. In addition, the diameter of the transfer roller 47 is greater at opposite end portions than at the center portion in the axial direction of the roller 47. With this configuration, the transfer roller 47 sags little despite its own weight. This successfully reduces the variation of the width of the roller portion contacting the image carrier 42 and thereby reduces the local omission of a toner image ascribable to the sag of the roller 47. Further, the ratio in diameter between the center portion and the opposite end portions is optimized in order to further reduce the sag of the roller 47. The roller 47 therefore contacts the image carrier 42 in a straight position and obviates the local omission of a toner image.

A fourteenth to a sixteenth embodiment of the present invention each use any one of the transfer rollers of the second to fourth embodiments in place of the above transfer roller 47, although not shown or described specifically. The fourteenth to sixteenth embodiments achieve the same advantages as the second to fourth embodiments.

Figure 10:
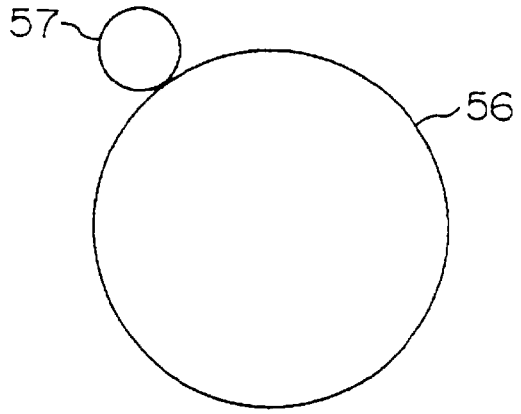

FIG. 10 shows a seventeenth embodiment of the present invention applied to a charge roller 57 representative of a charger. A drive section, not shown, causes a photoconductive drum or image carrier 56 to rotate while the charge roller 57 uniformly charges the surface of the drum 56. An optical writing unit, not shown, scans the charged surface of the drum 56 in order to form a latent image. A developing unit, not shown, develops the latent image to thereby produce a corresponding toner image. An image transfer device transfers the toner image from the drum 56 to a paper fed from a sheet feeder not shown. A fixing unit, not shown, fixes the toner image on the paper. The paper or print coming out of the fixing unit is driven out to a tray not shown.

The charge roller 57 is pressed against the drum 56 with opposite ends of its metallic core pressed by a pressing device not shown. A bias power source, not shown, applies a bias to the charge roller 57 in order to cause it to uniformly charge the drum 56. The charge roller 57 is positioned above a horizontal plane containing the axis of the drum 56. More specifically, assume a horizontal plane containing the axis of the drum 56, and an angular range of 45° to 135° as measured from the horizontal plane in the counterclockwise direction. Then, the charge roller 57 should preferably be pressed against the drum 56 within the above angular range, i.e., a range extending over 45° from the top of the drum 56 right above the axis of the drum 56 in each of the clockwise and counterclockwise directions with respect to the rotation of the drum 56.

As stated above, in the illustrative embodiment, the charge roller 57 is positioned within the range of ±90° from the top of the drum or image carrier 56 in the direction of rotation of the drum 56. In addition, the diameter of the charge roller 57 is greater at opposite end portions than at the center portion in the axial direction of the roller 57. With this configuration, the charge roller 57 sags little despite its own weight. This successfully reduces the variation of the width of the roller portion contacting the drum 56 and thereby reduces irregular charging ascribable to the sag of the roller 57. Further, the ratio in diameter between the center portion and the opposite end portions is optimized in order to further reduce the sag of the roller 57. The roller 57 therefore contacts the image carrier 56 in a straight position and obviates irregular charging ascribable to the sag of the roller 57.

An eighteenth to a twentieth embodiment of the present invention each provide the charge roller 57 with the same configuration as any one of the transfer rollers of the second to fourth embodiments, although not shown or described specifically. The eighteenth to twentieth embodiments achieve the same advantages as the seventeenth embodiment.

Figure 11:
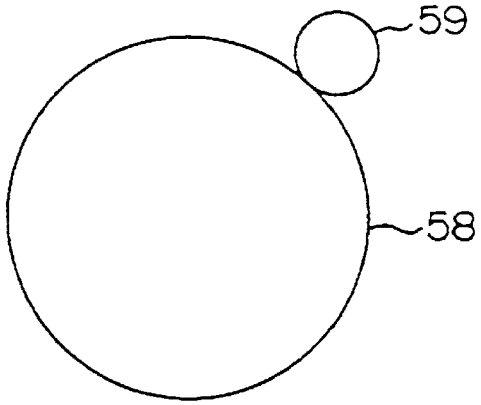

FIG. 11 shows a twenty-first embodiment of the present invention applied to a developing roller 59 representative of a developing unit. A drive section, not shown, causes a photoconductive drum or image carrier 58 to rotate while a charger, not shown, uniformly charges the surface of the drum 58. An optical writing unit, not shown, scans the charged surface of the drum 56 in order to form a latent image. The developing roller 59 develops the latent image to thereby produce a corresponding toner image. An image transfer device, not shown, transfers the toner image from the drum 58 to a paper fed from a sheet feeder not shown. A fixing unit, not shown, fixes the toner image on the paper. The paper or print coming out of the fixing unit is driven out to a tray not shown.

The developing roller 59 is pressed against the drum 58 with opposite ends of its metallic core pressed by a pressing device not shown. A bias power source, not shown, applies a bias for development to the developing roller 59. The developing roller 59 in rotation develops the latent image formed on the drum 58 with a developer deposited thereon. The developing roller 59 is positioned above a horizontal plane containing the axis of the drum 58. More specifically, assume a horizontal plane containing the axis of the drum 58, and an angular range of 45° to 135° as measured from the horizontal plane in the counterclockwise direction. Then, the developing roller 59 should preferably be pressed against the drum 58 within the above angular range, i.e., a range extending over 45° from the top of the drum 58 right above the axis of the drum 58 in each of the clockwise and counterclockwise directions with respect to the rotation of the drum 58.

As stated above, in the illustrative embodiment, the developing roller 59 is positioned within the angular range of ±90° from the top of the drum or image carrier 58 in the direction of rotation of the drum 58. In addition, the diameter of the developing roller 59 is greater at opposite end portions than at the center portion in the axial direction of the roller 59. With this configuration, the developing roller 59 sags little despite its own weight. This successfully reduces the variation of the width of the roller portion contacting the drum 58 and thereby reduces irregular development ascribable to the sag of the roller 59. Further, the ratio in diameter between the center portion and the opposite end portions is optimized in order to further reduce the sag of the roller 59. The roller 59 therefore contacts the image carrier 58 in a straight position and obviates irregular development ascribable to the sag of the roller 59.

A twenty-second to a twenty-fourth embodiment of the present invention each provide the developing roller 59 with the same configuration as any one of the transfer rollers of the second to fourth embodiments, although not shown or described specifically. The twenty-second to twenty-fourth embodiments achieve the same advantages as the twenty-first embodiment.

Figure 12:
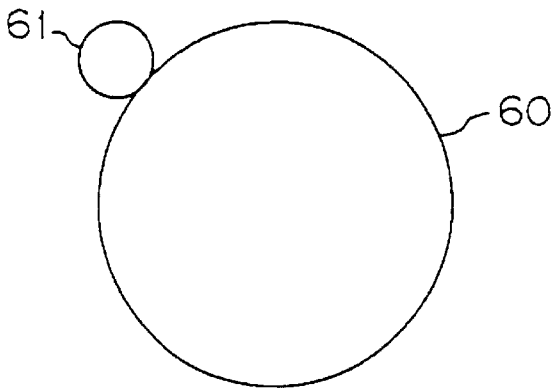

FIG. 12 shows a twenty-fifth embodiment of the present invention applied to a cleaning roller 61 representative of a drum cleaning device. A drive section, not shown, causes a photoconductive drum or image carrier 60 to rotate while a charger, not shown, uniformly charges the surface of the drum 58. An optical writing unit, not shown, scans the charged surface of the drum 60 in order to form a latent image. A developing device develops the latent image to thereby produce a corresponding toner image. An image transfer device, not shown, transfers the toner image from the drum 60 to a paper fed from a sheet feeder not shown. A fixing unit, not shown, fixes the toner image on the paper. The paper or print coming out of the fixing unit is driven out to a tray not shown. After the image transfer, the drum cleaning roller 61 cleans the surface of the drum 60, i.e., removes toner left on the drum 60.

The cleaning roller 61 is pressed against the drum 60 with opposite ends of its metallic core pressed by a pressing device not shown. The cleaning roller 61 is positioned above a horizontal plane containing the axis of the drum 60. More specifically, assume a horizontal plane containing the axis of the drum 60, and an angular range of 45° to 135° from the horizontal plane in the counterclockwise direction. Then, the cleaning roller 61 should preferably be pressed against the drum 60 within the above angular range, i.e., a range extending over 45° from the top of the drum 60 right above the axis of the drum 60 in each of the clockwise and counterclockwise directions with respect to the rotation of the drum 60.

As stated above, in the illustrative embodiment, the cleaning roller 61 is positioned within the angular range of ±90° from the top of the drum or image carrier 60 in the direction of rotation of the drum 60. In addition, the diameter of the cleaning roller 61 is greater at opposite end portions than at the center portion in the axial direction of the roller 61. With this configuration, the cleaning roller 61 sags little despite its own weight. This successfully reduces the variation of the width of the roller portion contacting the drum 60 and thereby reduces irregular cleaning ascribable to the sag of the roller 61. Further, the ratio in diameter between the center and the opposite ends is optimized in order to further reduce the sag of the roller 61. The roller 61 therefore contacts the image carrier 60 in a straight position and obviates irregular cleaning ascribable to the sag of the roller 61.

A twenty-sixth and a twenty-seventh embodiment of the present invention each provide the above cleaning roller 61 with the same configuration as any one of the transfer rollers of the second to fourth embodiments. The twenty-sixth and twenty-seventh embodiments achieve the same advantages as the twenty-fifth embodiment.

In summary, in accordance with the present invention, a charge roller, developing roller, transfer roller, cleaning roller or similar roller included in an image forming apparatus sags little despite its own weight. This successfully reduces the variation of the width of the portion of the roller contacting an image carrier and thereby reduces the local omission of a toner image ascribable to the sag of the roller. Further, the ratio in diameter, hardness or density between the center portion and the opposite end portions of the roller is optimized in order to further reduce the sag of the roller. The roller therefore contacts the image carrier in a straight position and obviates the local omission of a toner image ascribable to the sag. Further, even when the roller sags due to its own weight, the potential of the roller remains substantially uniform and obviates the local omission of a toner image.

Various modifications will become possible for those skilled in the art after receiving the teachings of the present disclosure without departing from the scope thereof. For example, in any one of the seventeenth to twenty-seventh embodiments, the photoconductive drum or image carrier may be replaced with a photoconductive belt, an intermediate transfer drum or an intermediate transfer belt.

What is claimed is:

1. An image forming apparatus comprising:

an image carrier; and an elastic transfer roller configured to press against said image carrier, and configured to convey a recording medium between said elastic transfer roller and said image carrier to thereby transfer a toner image from said image carrier to said recording medium, said elastic transfer roller positioned in an angular range of less than 45° from a top of said image carrier in a direction of rotation of said image carrier and has a greater diameter at opposite end portions than at a center portion in an axial direction of said transfer roller, wherein the top of said image carrier is a line on an upper side of said image carrier intersecting a plane through a rotational axis of the image carrier and perpendicular to a horizon.

2. An apparatus as claimed in claim 1, wherein said image carrier comprises one of a photoconductive drum, a photoconductive belt, an intermediate transfer drum, and an intermediate transfer belt.

3. An apparatus as in claim 1, wherein a ratio in diameter between the center portion and the opposite end portions in an axial direction of said transfer roller is optimized so the image carrier linearly contacts the elastic transfer roller.

4. An apparatus as in claim 3, wherein a length of the elastic transfer roller measured along a rational axis of the elastic transfer roller is at least 350 mm.

5. An apparatus as in claim 1, wherein a length of the elastic transfer roller measured along a rotational axis of the elastic transfer roller is at least 350 mm.

* * * * *